US008550760B2

(12) United States Patent
Schilling et al.

(10) Patent No.: US 8,550,760 B2
(45) Date of Patent: Oct. 8, 2013

(54) DEVICE FOR SHAPING A BOOK CASING SPINE TO BE ORIENTED APPROXIMATELY EVENLY DISTRIBUTED TOWARD A BOOK BLOCK SPINE

(75) Inventors: Holger Schilling, Bad Mergentheim (DE); Thomas Friese, Leipzig (DE)

(73) Assignee: Mueller Martini Holding AG, Hergiswil (CH)

( * ) Notice: Subject to any disclaimer, the term of this patent is extended or adjusted under 35 U.S.C. 154(b) by 172 days.

(21) Appl. No.: 12/873,391

(22) Filed: Sep. 1, 2010

(65) Prior Publication Data

US 2011/0052347 A1 Mar. 3, 2011

(30) Foreign Application Priority Data

Sep. 3, 2009 (EP) ..... 09405147

(51) Int. Cl.

| | |
|---|---|
| ***B42C 7/00*** | (2006.01) |
| ***B42C 11/00*** | (2006.01) |
| ***B42C 13/00*** | (2006.01) |
| ***B42B 9/00*** | (2006.01) |

(52) U.S. Cl.
USPC ..... 412/17; 412/3; 412/4; 412/5; 412/22; 412/23

(58) Field of Classification Search
USPC ..... 412/3–5, 17, 19–23
See application file for complete search history.

(56) References Cited

U.S. PATENT DOCUMENTS

| | | | | |
|---|---|---|---|---|
| 3,201,810 | A * | 8/1965 | Throp | 412/21 |
| 3,398,038 | A * | 8/1968 | Crawford | 412/17 |
| 5,868,539 | A * | 2/1999 | Rathert | 412/5 |
| 6,364,590 | B1 * | 4/2002 | Gayoso | 412/22 |
| 7,918,775 | B2 * | 4/2011 | Pohlmann | 493/402 |
| 2007/0092357 | A1 * | 4/2007 | Muller | 412/22 |
| 2007/0286705 | A1 * | 12/2007 | Sasamoto et al. | 412/21 |

FOREIGN PATENT DOCUMENTS

| | | |
|---|---|---|
| DE | 1436086 | 1/1939 |
| DE | 19853254 A1 | 5/2000 |
| DE | 10057600 A1 | 2/2002 |
| DE | 10057602 A1 | 5/2002 |
| DE | 10 2006 03317 A1 | 1/2008 |
| GB | 1 501 443 A | 2/1978 |

OTHER PUBLICATIONS

Libau/Heinze, "Industrial Bookbinding," ISBN 3-88013-596-7, Edition 2001.

European Search Report Dated Mar. 1, 2010 With English Translation.

* cited by examiner

*Primary Examiner* — Kyle Grabowski

(74) *Attorney, Agent, or Firm* — Venable LLP; Robert Kinberg; Tamatane J. Aga

(57) ABSTRACT

A device is provided to shape a spine of a book casing positioned horizontally spread out flat and oriented to be distributed evenly over a spine of a book block. Two fold-shaping rails are arranged extending in a direction parallel to one another. A movable, shaping tool is arranged to face the inside of the book casing spine to shape a web on the book casing spine with the aid of the two fold-shaping rails. The shaping tool includes two spaced-apart support bars that extend parallel to the fold-shaping rails and are arranged to be adjustable so that together they adjust the web width of the book casing spine in a direction transverse to the direction of extension of the fold-shaping rails.

14 Claims, 4 Drawing Sheets

DEVICE FOR SHAPING A BOOK CASING SPINE TO BE ORIENTED APPROXIMATELY EVENLY DISTRIBUTED TOWARD A BOOK BLOCK SPINE

CROSS-REFERENCE TO RELATED APPLICATION

This application claims the priority of European Patent Application No. 09405147.1, filed on Sep. 3, 2009, the subject matter of which is incorporated herein by reference.

BACKGROUND OF THE INVENTION

The invention relates to a device for shaping a book casing spine, which may be provided with a back strip or inlay, which casing is positioned flat while oriented to be spread out approximately evenly distributed over a book block spine. Such a device usually includes a high-performance shaping tool that can be advanced toward the inside of the book casing spine, which is facing the book block spine, to lift up the book casing spine between two fold-shaping rails arranged on opposite sides, to generate a web on the book casing spine. Following a preceding partial process during which a book block spine is processed, hard-cover books are produced in the industry by combining a book casing and a book block in the back region, just prior to the final pressing and joint shaping. These processing steps substantially determine the structural stability of a book during reading and for storage on the book on a shelf.

The device described herein is located adjacent to a casing-in machine in a book-production line. To obtain a high quality book, the shaping of a book casing in the center region and/or the spine region plays an important role, wherein a precise joining of the book block and the book casing along the edges is critical for an aesthetic binding.

The published, unexamined German patent application 1,436,086 describes and shows a book-binding machine comprising a station for joining different book components in series, in particular a configuration for a device of the aforementioned type. The book casings are stacked inside a magazine, pulled individually from the stack underside, and transported to a forming and folding station to shape and fold the book casing spine. The book casing, which is shaped along the spine, is then guided along side guides to the binding and casing-in station, designed to encase the book block which is supplied from below.

German patent document DE 198 53 254 A1 discloses a device for the rounding of book casings which differ from a device for shaping a book casing spine with a flat or straight spine shape through a rectangular shaping web. A web shaping web device is respectively replaced when the book block thickness changes and the shaping device and/or the fold-forming rails must accordingly be adjusted to match the change. A correspondingly longer conversion time is necessary at the casing-in machine as a result of the manual replacement of the shaping tools and books with different thicknesses cannot be processed in an economical manner.

SUMMARY

It is therefore an object of the present invention to create a device of the aforementioned type which can be used for different book thicknesses and is easy to operate.

The above and other objects are achieved by the provision a device to shape a spine of a book casing positioned horizontally spread out flat and oriented to be distributed evenly over a spine of a book block, wherein in one embodiment the device comprises two fold-shaping rails arranged extending in a direction parallel to one another; and a movable, shaping tool arranged to face the inside of the book casing spine to shape a web on the book casing spine with the aid of the two fold-shaping rails, wherein the shaping tool includes two spaced-apart support bars that extend parallel to the fold-shaping rails and are arranged to be adjustable so that together they adjust the web width of the book casing spine in a direction transverse to the direction of extension of the fold-shaping rails.

Thus, according to an embodiment of the invention disclosed herein the shaping tool comprises two spaced-apart support bars which extend parallel to the fold-shaping rails and are embodied so as to be adjustable, relative to each other, for adjusting the web width of the book casing spine in a transverse direction to the extension of the fold-shaping rails.

The aforementioned disadvantages are thus corrected and a device is provided which is universally useable for flat or straight book casing spines.

BRIEF DESCRIPTION OF THE DRAWINGS

These and other features and advantages of the invention will be further understood from the following detailed description, with reference to the accompanying drawings.

DETAILED DESCRIPTION

Figure 1:
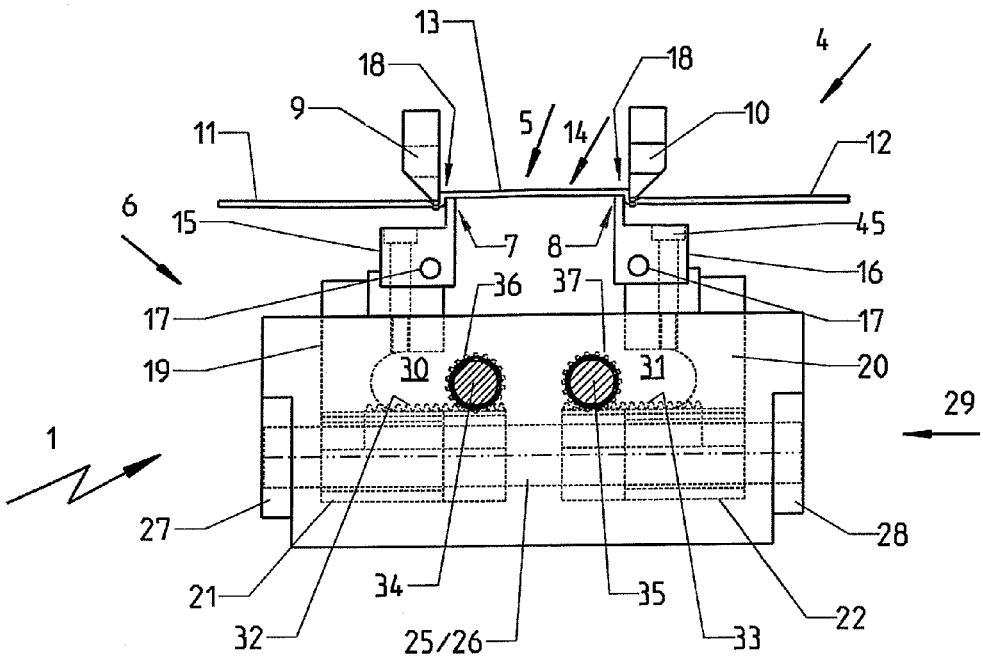
FIG. 1 is a schematic cross section through the device according to the invention as shown in FIG. 4, adjusted for a maximum book thickness.

FIGS. 1 to 5 represent a device 1 for shaping a spine 5 of a book casing 4 that is oriented to be approximately evenly distributed over a spine of a book block (not shown). The book casing spine may optionally be provided with a back insert or inlay, (not visible herein). The back insert, also called a center strip, is located between the front section and the back section of the book cover and/or the cover material used and consists of gray board or waste paper. Other references to such a back insert or the material used can be found in German patent documents DE 10057600 and DE 10057602, in connection with the production of book casings. The document "Industrielle Buchbinderei" [Industrial Bookbinding] by Libau/Heinze, Edition 2001, ISBN 3-88013-596-7, makes reference to a back insert for book casings shown in image 5.35 and the associated text, which refers to the rounding principle.

FIGS. 1 to 4 furthermore show the device 1 during the shaping of a flat spine, following the horizontal spreading out of the book casing 4 prior to the shaping of the center region and/or the book casing spine 5. For the purpose of shaping the spine, the device 1 includes a shaping tool 6 which extends perpendicular to the drawing plane for FIGS. 1 and 2, and at least over the height of a book casing 4. The shaping tool 6 includes two support bars 7, 8 and is directed downward in the direction of the downward-pointing inside of the book casing spine 5 or the book casing center region. The shaping tool 6 may be raised or lowered approximately vertically for raising up the center region of the casing.

Figure 2:
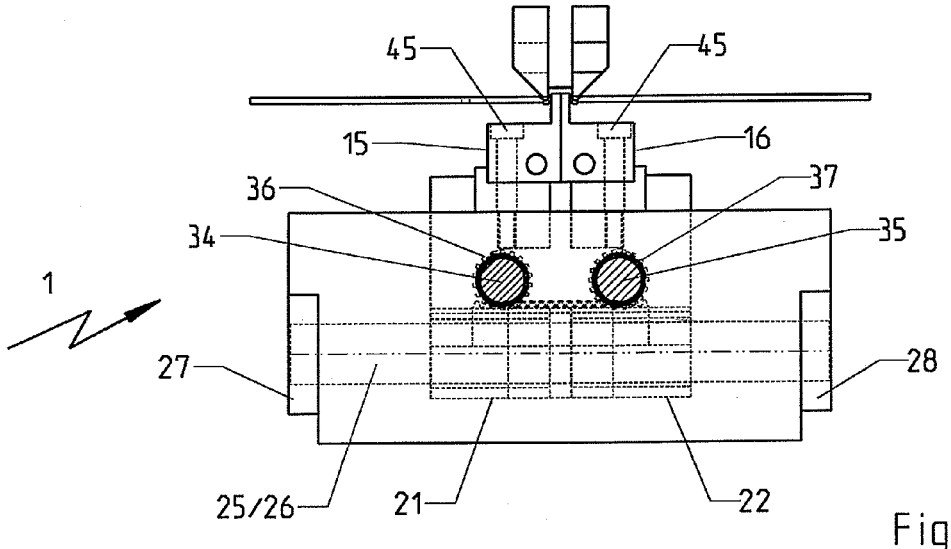
FIG. 2 is a schematic cross section through the device shown in FIG. 3, adjusted for a minimum book thickness.

FIGS. 1 and 2 show the rail-type shaping tool 6 in the operating position in which the latter is raised for lifting up the book casing spine 5 to form a web 14. Two fold-shaping rails 9, 10 are respectively arranged opposite each other, one on each side and on the outside of the support bars 7, 8, to form a hinge between respectively one book casing section 11, 12 and the book casing spine 5 of the book casing 4, thereby causing the book casing spine 5 to be reconfigured. In the process, the material 13 forms the web 14 which extends over the support bars 7, 8 of the rail-type shaping tool 6. The relatively small support bars 7, 8, which respectively project upward from a base rail 15, 16, transfer the heat of heating ducts 17 in the base rails 15, 16 to the book casing spine 5, in particular to the end regions 18 of the web 14.

Figure 3:
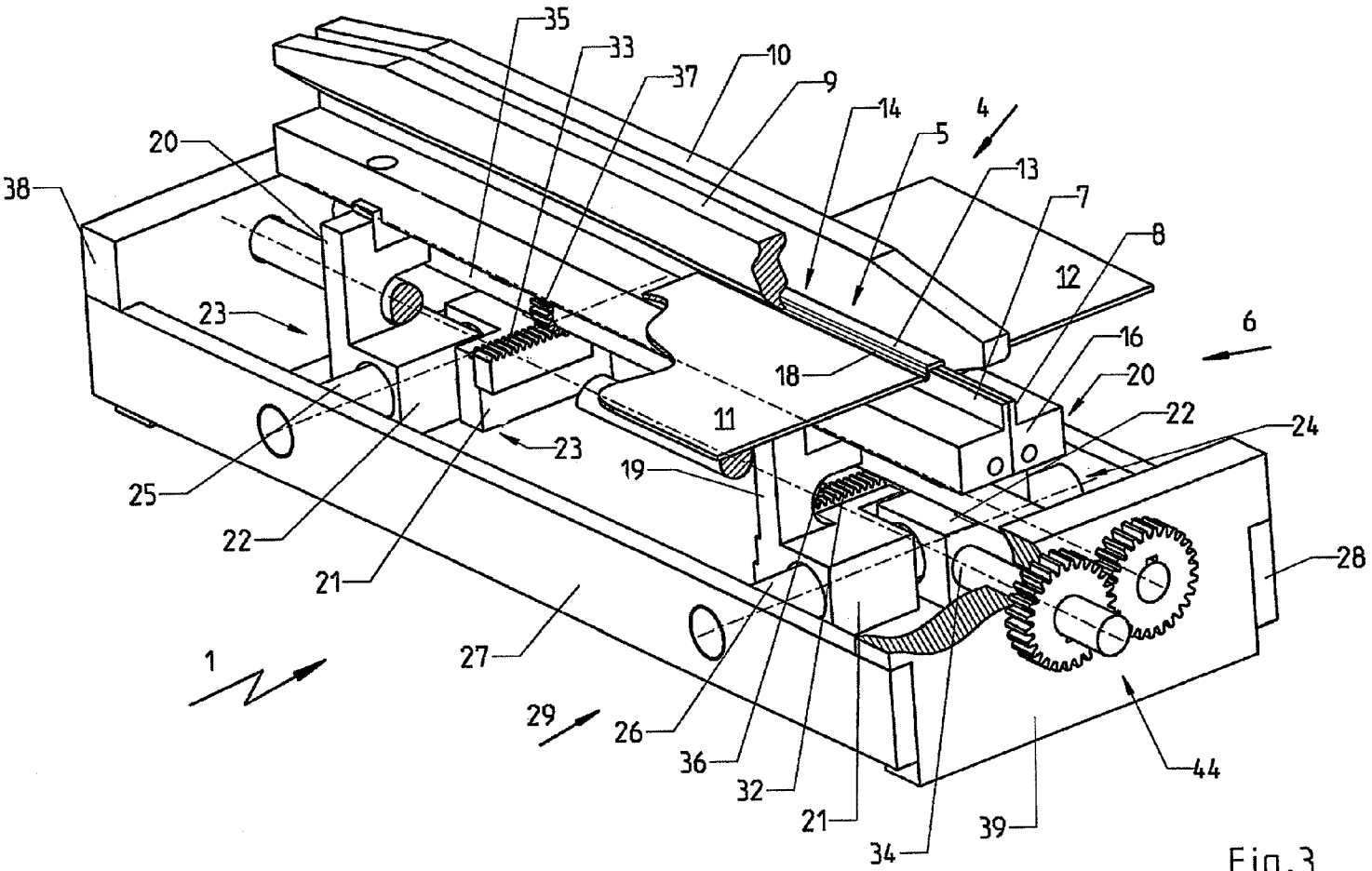
FIG. 3 is a three-dimensional representation of the device according to the invention, adjusted for a minimum book thickness.

The width of the support bars 7, 8 along the top and/or on the inside facing the book casing spine 5 helps determine the thickness of the book blocks to be provided with a book casing 4, for example as can be seen clearly in FIGS. 1 and 2. The base rails 15, 16 rest on supports 19, 20 which are respectively attached to a second guide element 21, 22 of a guide device 23, 24. A first guide element 25, 26 of the guide device 23, 24, which may be a cylindrical guide rod for the sake of simplicity, is attached with its respective ends to a side panel 27, 28 of a frame 29 that accommodates the device 1. The respectively adjustable second guide element 21, 22, on which the base rails 15, 16 that are provided with support elements 7, 8 are supported by the supports 19, 20, is positioned with the aid of sliding bearings or roller bearings in respectively the first guide element 25, 26, so as to be displaceable in a longitudinal direction of the first guide elements 25, 26. The base rails 15, 16 of the support bars 7, 8 are thus connected via the supports 19, 20 to the second guide elements 21, 22. FIG. 3 shows that the guide devices 23, 24, which are arranged spaced apart along the fold-shaping rails 9, and are connected to a support bar 7, 8, may be embodied identical for the sake of simplicity. FIGS. 1 and 2 illustrate the guide device 23, 24 with dashed lines, as seen from the side. FIG. 1 shows the support bars 7, 8 with a maximum spacing and FIG. 2 shows the support bars 7, 8 fitting close together, meaning for the narrowest width of a book casing spine 5.

FIGS. 1 and 2 show the design of the supports 19, which are connected to the support bars 7, 8 via the base rails 15, 16, as well as the approximately U-shaped recesses 30, 31 in the supports 19, 20. At the lower leg of the recesses 30, 31, or as seen displaced in the direction of the fold-shaping rails 9, 10, respectively one gear bar 32, 33 is connected to the second guide element 21, 22, with respectively one gearwheel 36, 37 engaged therein. Gearwheels 36,37 are respectively attached to drive shafts 34, 35 positioned parallel to the fold-shaping rails 9, 10 and extending through U-shaped recesses 30, 31 in the frame 29.

The drive shaft 34 is shown interrupted in FIG. 3 to provide a better understanding of how the individual parts of the device 1 are arranged. The drive shafts 34, 35 are positioned in the end panels 38, 39 of the frame 29. In place of the embodiment shown in FIGS. 3 to 5, it is possible to assign a separate drive unit, for example a rack and pinion drive, via the drive shafts 34, 35, to each of the two guide devices 23, 24 of a support rail 7, 8. This results in higher machine expenditure, but has a positive effect on the accuracy and higher functionality.

Figure 4:
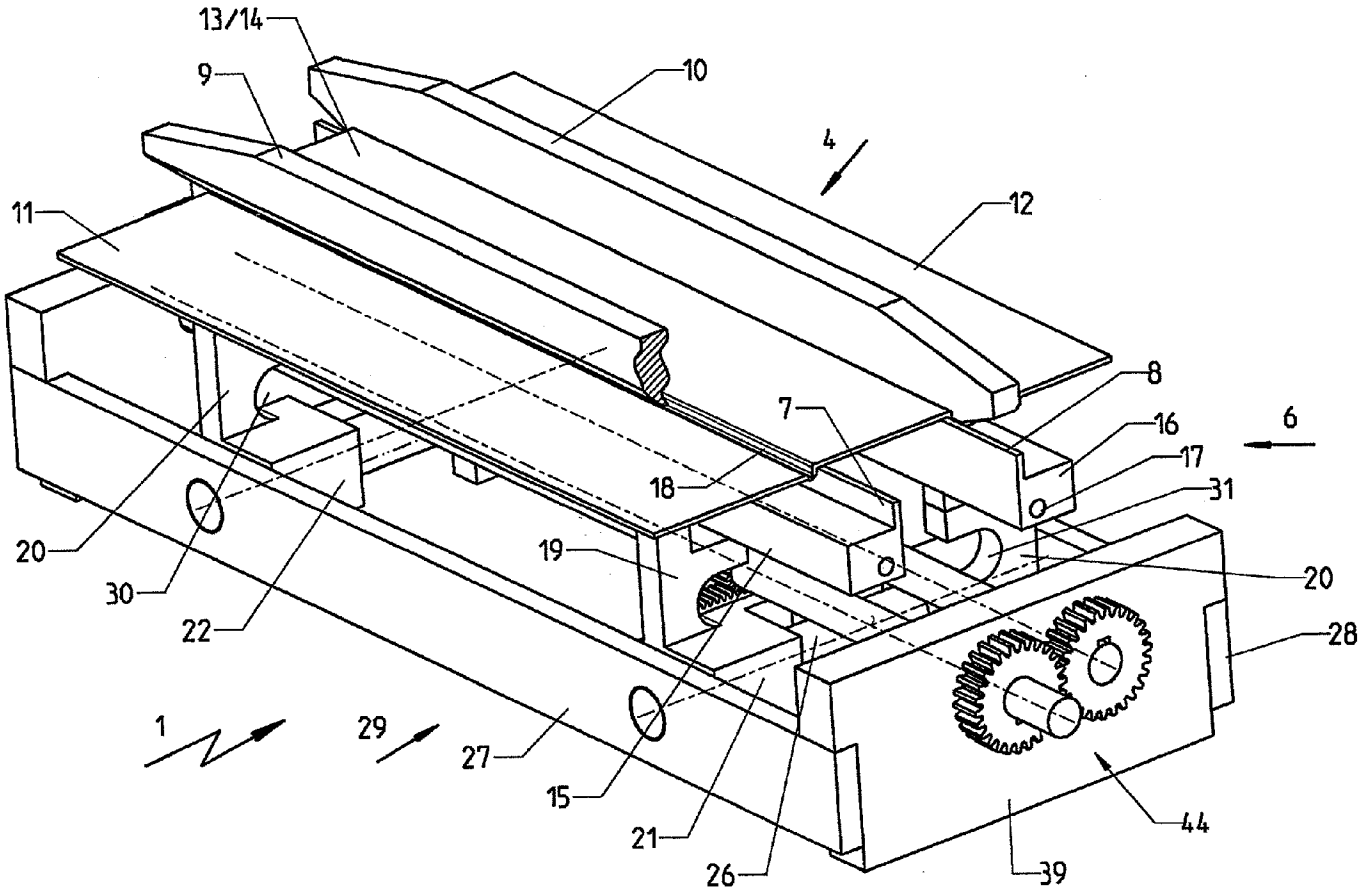
FIG. 4 is a three-dimensional representation of the device according to the invention, adjusted for a maximum book thickness.
Figure 5:
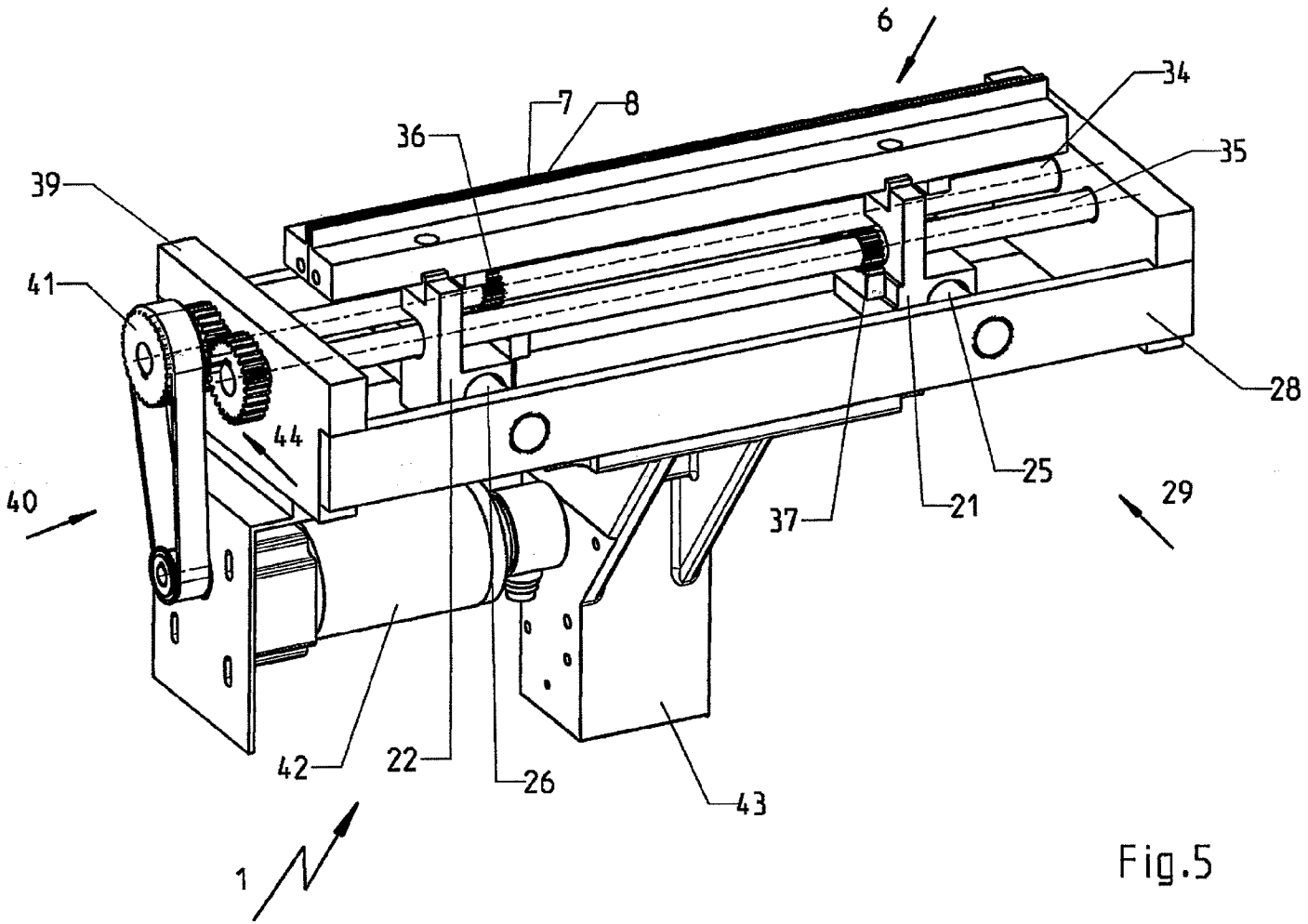
FIG. 5 is a three-dimensional representation of the device according to the invention, provided with a rotational-angle controlled drive motor.

With the embodiment according to FIGS. 3 to 5, the support bars 7, 8 are assigned separate drive units which respectively act only upon one guiding device 23, 24. To achieve a compact configuration, the gear bars 32, 33 that are assigned to the support bars 7, 8 coincide in the position where the support bars 7, 8 are next to each other. The support bars 7, 8 are secured by screws 45 to the second guide elements 21, 22, as can be seen in FIGS. 1 and 2 and therefore may be easily replaced.

FIG. 5 shows that the drive shaft 34 is drive-connected via a gear wheel 41 of a belt transmission 40 to an electric motor 42 which is attached to the frame 29. Electric motor 42 may be an angle of rotation-controlled motor.

FIG. 5 further shows a portion of the machine frame 43 on which the device 1 is mounted. The drive shaft 35 is driven by a toothed wheel gearing 44 and the drive shafts 34, 35 extend outside of the frame 29 (see FIGS. 3 to 5).

It will be understood that the above description of the present invention is susceptible to various modifications, changes and adaptations, and that the same are intended to be comprehended within the meaning and range of equivalents of the appended claims.

What is claimed is:

1. A device to shape a flat or straight spine of a book casing positioned horizontally spread out flat and oriented to be distributed evenly over a flat or straight spine of a book block, comprising:

a first fold-shaping rail and a second fold-shaping rail, the first and second fold shaping rails arranged extending in a direction parallel to one another and each having a side edge to define an open space therebetween; and a movable, shaping tool arranged to face the inside of the book casing spine to shape a web on the book casing spine, wherein the shaping tool includes two spaced-apart support bars that extend parallel to the first and second fold shaping rails and into the space between the first and second fold shaping rails to cooperate with a relative movement of the fold-shaping rails to form the flat or straight book casing spine and which are arranged to be adjustable so that together the adjustable support bars adjust the web width of the book casing spine in a direction transverse to the direction of extension of the fold-shaping rails wherein the support bars raise the book casing into the space between the first and second fold shaping rails to form the flat or straight spine extending from the first fold shaping rail to the second fold shaping rail.

2. The device according to claim 1, further comprising a motor coupled to the support bars to adjust the support bars.

3. The device according to claim 1, further comprising at least one guide device arranged to aid in the adjustment of the support bars, respectively.

4. The device according to claim 3, further comprising a frame, and wherein the at least one guide device includes respectively a first guide element connected to the frame and a second guide element displaceably guided on the first guide element and operatively associated with one of the support bars.

5. The device according to claim 4, wherein the second guide element is arranged to be driven.

6. The device according to claim 4, wherein the support bars are replaceably connected to the second guide element, respectively.

7. The device according to claim 4, wherein the second guide element includes a driven gearwheel and a gear bar connected to the driven gearwheel.

8. The device according to claim 7, wherein the at least one guide device comprises at least two spaced-apart guide devices which are respectively operatively associated with a respective one of the support bars that are arranged on a frame of the shaping tool.

9. The device according to claim 8, wherein the spaced-apart guide devices each comprises a drive unit including a gear bar and a gearwheel.

10. The device according to claim 9, further including drive shafts each connected to a respective one of the gearwheels.

11. The device according to claim 10, wherein shaping tool includes the drive shafts which are parallel to one another.

12. The device according to claim 1, further comprising an electromechanical or pneumatic drive arranged to adjust the support bars.

13. The device according to claim 1, further comprising a rack and pinion drive arranged to adjust the support bars.

14. The device according to claim 1, further comprising an angle of rotation controlled electric motor drive arranged to adjust the support bars.

* * * * *